US008417520B2

(12) United States Patent
Virette et al.

(10) Patent No.: US 8,417,520 B2
(45) Date of Patent: Apr. 9, 2013

(54) ATTENUATION OF OVERVOICING, IN PARTICULAR FOR THE GENERATION OF AN EXCITATION AT A DECODER WHEN DATA IS MISSING

(75) Inventors: David Virette, Pleumeur Bodou (FR); Balazs Kovesi, Lannion (FR)

(73) Assignee: France Telecom, Paris (FR)

( * ) Notice: Subject to any disclaimer, the term of this patent is extended or adjusted under 35 U.S.C. 154(b) by 0 days.

(21) Appl. No.: 12/446,280

(22) PCT Filed: Oct. 17, 2007

(86) PCT No.: PCT/FR2007/052188

§ 371 (c)(1),
(2), (4) Date: Jun. 24, 2009

(87) PCT Pub. No.: WO2008/047051

PCT Pub. Date: Apr. 24, 2008

(65) Prior Publication Data

US 2010/0324907 A1 Dec. 23, 2010

(30) Foreign Application Priority Data

Oct. 20, 2006 (FR) ..... 0609225

(51) Int. Cl.
*G10L 21/02* (2006.01)
*G10L 19/14* (2006.01)

(52) U.S. Cl. ..... 704/228; 704/211

(58) Field of Classification Search ..... None
See application file for complete search history.

(56) References Cited

U.S. PATENT DOCUMENTS

| | | | | |
|---|---|---|---|---|
| 4,907,277 | A * | 3/1990 | Callens et al. | 704/202 |
| 5,732,356 | A * | 3/1998 | Bolt | 455/462 |
| 7,711,563 | B2 * | 5/2010 | Chen | 704/262 |
| 7,805,297 | B2 * | 9/2010 | Chen | 704/228 |
| 7,930,176 | B2 * | 4/2011 | Chen | 704/228 |

(Continued)

FOREIGN PATENT DOCUMENTS

| | | | |
|---|---|---|---|
| FR | 2 813 722 | A1 | 3/2002 |
| WO | 02/21515 | A1 | 3/2002 |
| WO | 2006/079348 | A1 | 8/2006 |

OTHER PUBLICATIONS

Combescure et al., "A 16, 24, 32 Kbit/s Wideband Speech Codec Based on ATCELP," Proceedings of IEEE International Conference on Acoustics, Speech, and Signal Processing, vol. 1, pp. 5-8 (1999).

*Primary Examiner* — Brian Albertalli
(74) *Attorney, Agent, or Firm* — Drinker Biddle & Reath LLP

(57) ABSTRACT

The invention proposes the synthesis of a signal consisting of consecutive blocks. It proposes more particularly, on receipt of such a signal, to replace, by synthesis, lost or erroneous blocks of this signal. To this end, it proposes an attenuation of the overvoicing during the generation of a signal synthesis. More particularly, a voiced excitation is generated on the basis of the pitch period (T) estimated or transmitted at the previous block, by optionally applying a correction of plus or minus a sample of the duration of this period (counted in terms of number of samples), by constituting groups (A',B', C',D') of at least two samples and inverting positions of samples in the groups, randomly (B',C') or in a forced manner. An over-harmonicity in the excitation generated is thus broken and the effect of overvoicing in the synthesis of the generated signal is thereby attenuated.

13 Claims, 5 Drawing Sheets

U.S. PATENT DOCUMENTS

| | | | | |
|---|---|---|---|---|
| 8,255,207 | B2 * | 8/2012 | Vaillancourt et al. | 704/219 |
| 8,255,210 | B2 * | 8/2012 | Sato et al. | 704/228 |
| 2002/0150183 | A1 * | 10/2002 | Miet | 375/343 |
| 2005/0180405 | A1 * | 8/2005 | Bastin | 370/352 |
| 2008/0154584 | A1 * | 6/2008 | Andersen | 704/211 |

* cited by examiner

ATTENUATION OF OVERVOICING, IN PARTICULAR FOR THE GENERATION OF AN EXCITATION AT A DECODER WHEN DATA IS MISSING

CROSS-REFERENCE TO RELATED APPLICATIONS

This application is the U.S. national phase of the International Patent Application No. PCT/FR2007/052188 filed Oct. 17, 2007, which claims the benefit of French Application No. 06 09225 filed Oct. 20, 2006, the entire content of which is incorporated herein by reference.

The present invention relates to the processing of digital audio signals, such as speech signals in telecommunication, in particular the decoding of such signals.

BACKGROUND OF THE INVENTION

Briefly, it will be recalled that a speech signal can be predicted from its recent past (for example from 8 to 12 samples at 8 kHz) using parameters assessed over short windows (10 to 20 ms in this example). These short-term predictive parameters representing the vocal tract transfer function (for example for pronouncing consonants), are obtained by linear prediction coding (LPC) methods. A longer-term correlation is also used to determine periodicities of voiced sounds (for example the vowels) resulting from the vibration of the vocal cords. This involves determining at least the fundamental frequency of the voiced signal, which typically varies from 60 Hz (low voice) to 600 Hz (high voice) according to the speaker. Then a long term prediction (LTP) analysis is used to determine the LTP parameters of a long-term predictor, in particular the inverse of the fundamental frequency, often called "pitch period". The number of samples in a pitch period is then defined by the relationship $F_e/F_0$ (or its integer part), where:

$F_e$ is the sampling rate, and $F_0$ is the fundamental frequency.

It will be recalled therefore that the long-term prediction LTP parameters, including the pitch period, represent the fundamental vibration of the speech signal (when it is voiced), while the short-term prediction LPC parameters represent the spectral envelope of this signal.

The set of these LPC and LTP parameters thus resulting from a speech coding is transmitted by blocks to a homologous decoder via one or more telecommunications networks so that the original speech can then be reconstructed.

Within the framework of the communication of such signals by blocks, the loss of one or more consecutive blocks can occur. By the term "block" is meant a succession of signal data which can be for example a frame in mobile radiocommunication, or also a packet for example in communication over internet protocol (IP) or others.

In mobile radiocommunication for example, most predictive synthesis coding techniques, in particular coding of the "code excited linear predictive" (CELP) type, propose solutions for the recovery of erased frames. The decoder is informed of the occurrence of an erased frame, for example by the transmission of a frame erasure information originating from the channel decoder. The recovery of erased frames aims to extrapolate the parameters of the erased frame from one or more previous frames regarded as valid. Certain parameters manipulated or coded by the predictive coders have a high correlation between frames. Typically, this involves long-term prediction LTP parameters, for the voiced sounds for example, and short-term prediction LPC parameters. Due to this correlation, it is much more advantageous to reuse the parameters of the last valid frame in order to synthesize the erased frame, than to use random, even erroneous, parameters.

In standard fashion, for generating CELP excitation, the parameters of the erased frame are obtained as follows.

The LPC parameters of a frame to be reconstructed are obtained from the LPC parameters of the last valid frame, by simple copying of the parameters or also with introduction of a certain damping (technique used for example in the G723.1 standardized coder). Then, a voicing or a non-voicing is detected in the speech signal in order to determine a degree of harmonicity of the signal at the erased frame.

If the signal is non-voiced, an excitation signal can be randomly generated (by taking a code word from the past excitation, by slight damping of the gain of the past excitation, by random selection in the past excitation, or by using further transmitted codes which can be totally erroneous).

If the signal is voiced, the pitch period (also called "LTP delay") is generally that calculated for the previous frame, optionally with a slight "jitter" (increase in the value of the LTP delay for the consecutive error frames, the LTP gain being taken to be very close to 1 or equal to 1). The excitation signal is therefore limited to the long-term prediction carried out from a past excitation.

The means of concealment of the erased frames, at decoding, are generally strongly linked to the structure of the decoder and can be common to modules of this decoder, such as for example the signal synthesis module. These means also use intermediate signals available within the decoder, such as for example the past excitation signal stored during the processing of the valid frames preceding the erased frames.

Certain techniques used to conceal the errors produced by packets lost during the transport of data coded according to a time-type coding frequently rely on waveform substitution techniques. Such techniques aim to reconstitute the signal by selecting portions of the decoded signal before the lost period, and do not implement synthesis models. Smoothing techniques are also used to avoid the artefacts produced by the concatenation of different signals.

For the decoders operating on signals coded by transform coding, the techniques for reconstructing erased frames generally rely on the structure of the coding used. Certain techniques aim to regenerate the lost transformed coefficients from the values taken by these coefficients before the erasure.

Other techniques for concealment of the erased frames have been developed jointly with the channel coding. They make use of information provided by the channel decoder, for example information relating to the degree of reliability of the parameters received. It is noted here that conversely, the subject of the present invention does not presuppose the existence of a channel coder.

In Combescure et al.:

"A 16.24.32 kbit/s Wideband Speech Codec Based on ATCELP", P. Combescure, J. Schnitzler, K. Ficher, R. Kirchherr, C. Lamblin, A. Le Guyader, D. Massaloux, C. Quinquis, J. Stegmann, P. Vary, ICASSP (1998) Conference Proceedings, a proposal was made for the use of an erased-frame concealment method equivalent to that used in CELP coders for a transform coder.

The drawbacks of this method were the introduction of audible spectral distortions ("synthetic" voice, unwanted resonances, etc.). These drawbacks were due in particular to the use of poorly-controlled long-term synthesis filters (single harmonic component in voiced sounds, use of portions of the past residual signal in non-voiced sounds). Moreover, the energy control is carried out here at the excitation signal level and the energy target of this signal is kept constant for the whole duration of the erasure, which also generates troublesome audible artefacts.

In FR-2.813.722, a technique is proposed for concealment of the erased frames which does not generate greater distortion at higher error rates and/or for longer erased intervals. This technique aims to avoid the excess periodicity for the voiced sounds and to improve control of the generation of the unvoiced excitation. To this end, the excitation signal (if voiced) is regarded as the sum of two signals:

- a highly harmonic component whose band is limited to the low frequencies of the total spectrum, and
- another less harmonic component limited to the higher frequencies. The highly harmonic component is obtained by LTP filtering. The second component is also obtained by an LTP filtering made non-periodic by the random modification of its fundamental period.

SUMMARY OF THE INVENTION

The main problem of the error concealment technique hitherto used in CELP coders resides in the generation of the voiced excitation which, when several consecutive frames have been lost, can result in an overvoicing effect due to the repetition of the same pitch period over several frames.

The present invention offers an improvement on the situation.

To this end it proposes a method for synthesizing a digital audio signal represented by consecutive blocks of samples, in which on receiving such a signal, in order to replace at least one invalid block, a replacement block is generated from the samples of at least one valid block preceding the invalid block.

The method according to the invention comprises the following steps:

a) selecting a chosen number of samples forming a succession in at least one last valid block preceding the invalid block,
b) fragmenting the succession of samples into groups of samples, and, in at least one part of the groups, inverting the samples according to predetermined rules,
c) re-concatenating the groups, samples of at least some of which have been inverted in step b), in order to form at least one part of the replacement block, and
d) if said part obtained in step c) does not fill the whole of the replacement block, copying said part into the replacement block and applying steps a), b), c) again to said copied part.

The purpose of this inversion of samples, which therefore consists of a very simple manipulation of samples which has a low cost in terms of computation and processing means, is to "break" an over-harmonicity which may have been present if a simple copying of pitch period was used.

Thus, among the advantages offered by the present invention, its implementation requires only a very low computation cost.

Advantageously, the invention can be applied to the case where the digital audio signal is a voiced speech signal and more particularly, weakly voiced, as simple copying of the pitch period produces mediocre results in this case. Thus, according to an advantageous feature, a degree of voicing is detected in the speech signal and steps a) to d) are applied if the signal is at least weakly voiced.

The present invention advantageously relies on the fundamental frequency of the digital audio signal to constitute the groups in step b). Thus, advantageously, in step a):

a1) a tone is detected in the digital audio signal, and
a2) said chosen number of samples selected in step a) corresponds to the number of samples comprised by a period corresponding to the inverse of a fundamental frequency of the detected tone.

Of course, in the case of a speech signal, the operation a1) can consist of detecting a voicing and the operation a2) would involve, if the speech signal is voiced, selecting a number of samples which extends over a whole pitch period (inverse of a fundamental frequency of a voice tone). Nonetheless, it will be shown that this realization can also involve a signal other than a speech signal, in particular a musical signal, if a fundamental frequency specific to an overall music tone can be detected therein.

In an embodiment, the fragmentation of step b) is carried out by groups of two samples, and the positions of the samples of a single group can be inverted one with the other.

However, in this embodiment, it is appropriate to distinguish the case where the pitch period (or more generally the inverse period of the fundamental frequency) comprises an even or odd number of samples. In particular, if the number of samples comprised by the period of the detected tone is an even number, an odd number of samples (preferentially a single sample) is advantageously added to or subtracted from the samples of said period in order to form the selection of step a).

It is also appropriate to specify what is meant by the "predetermined rules of inversion". These rules, which can be chosen according to the characteristics of the signal received, in particular impose the number of samples per group at step b) and the manner of inverting the samples in a group. In the above embodiment, groups of two samples and a simple inversion of the respective positions of these two samples are provided. However, other configurations are possible (groups comprising more than two samples and permutation of all the samples of such groups). Moreover, the inversion rules can also set the number of groups in which the inversion is carried out. A particular embodiment consists of randomizing the instances of sample inversion in each group and setting a probability threshold for inverting, or not inverting, the samples of a group. This probability threshold can have a fixed value, or also a variable value and depend advantageously on a correlation function relating to the pitch period. In this case, the formal determination of the pitch period itself is not necessary. Moreover, more generally, the processing within the meaning of the invention can also be carried out if the valid signal received is simply non-voiced, in which case there is no actual detectable pitch period. In this case, it can be provided to set a given arbitrary number of samples (for example two hundred samples) and carry out the processing within the meaning of the invention on this number of samples. It is also possible to take the value corresponding to the maximum of the correlation function by limiting the search to a value interval (for example between MAX_PITCH/2 and MAX_PITCH, where MAX_PITCH is the maximum value in the pitch period search).

The present invention, which thus proposes the attenuation of overvoicing, offers the following advantages:

- the speech synthesized during a loss of a block no longer practically exhibits over-harmonicity or overvoicing phenomena, and
- the complexity necessary to generate a voiced excitation is very low, as will be apparent from the embodiment described in detail hereafter.

BRIEF DESCRIPTION OF THE DRAWINGS

Moreover, further advantages and features of the invention will become apparent on examination of the detailed description given by way of example hereafter, and of the attached drawings in which.

DETAILED DESCRIPTION OF THE INVENTION

Figure 4:
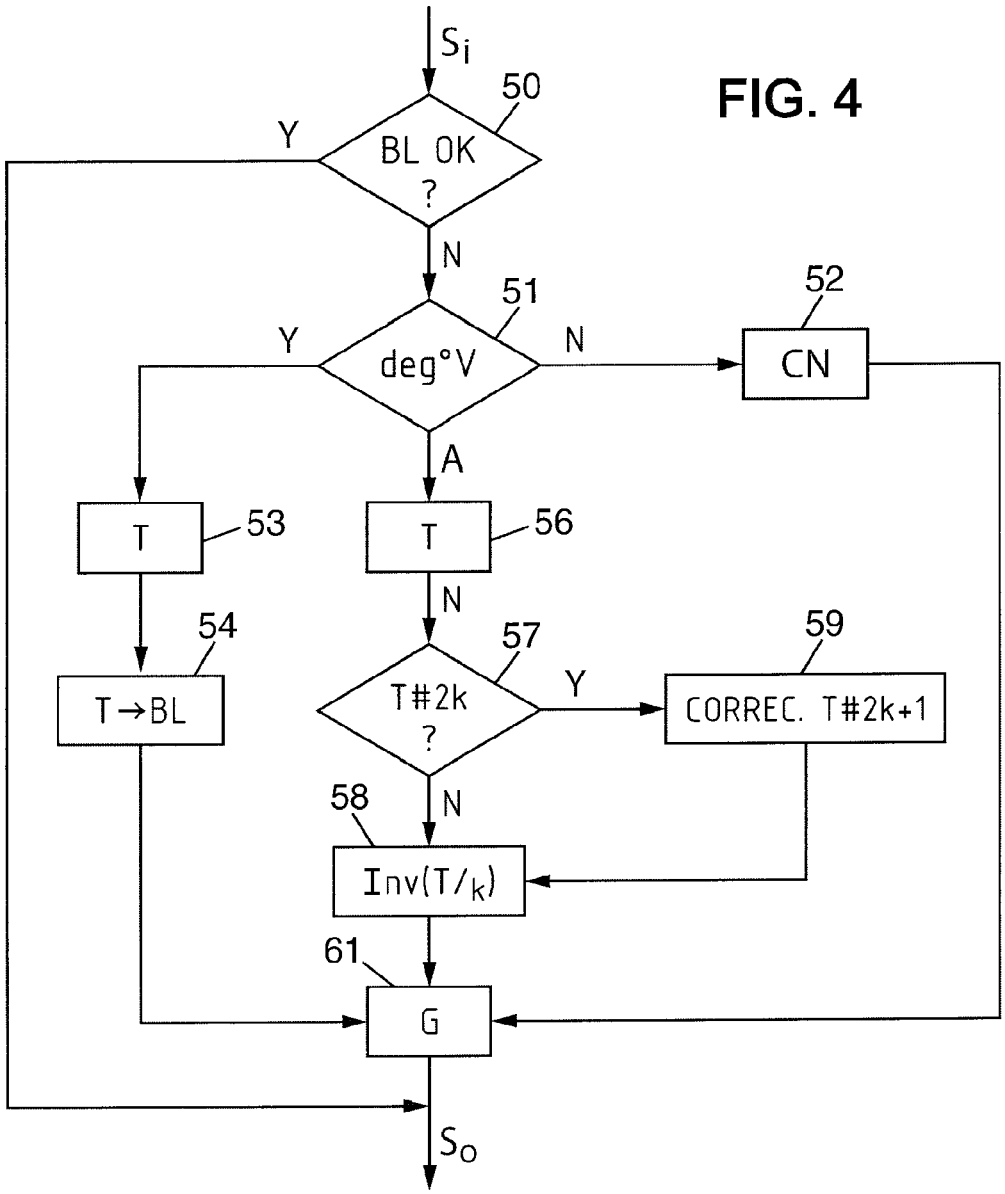
FIG. 4 illustrates diagrammatically the principal steps of a method within the meaning of the invention, at decoding.

Firstly, reference is made to FIG. 4 for illustrating the context of implementation of the present invention. On receiving an input signal Si at decoding, the loss of one or more consecutive blocks is detected (test 50). If no loss of a block is noted, (arrow Y at the output of test 50), of course no problem arises, and the processing of FIG. 4 is complete.

On the other hand, if the loss of one or more consecutive blocks is noted (arrow N at the output of test 50), the degree of voicing of the signal is then detected (test 51).

If the signal is non-voiced (arrow N at the output of test 51), the lost blocks are replaced for example by an audible white noise, called "comfort noise" 52, and the gain 61 of the samples of the blocks thus reconstructed is adjusted. A control can for example be carried out on the energy of the reconstructed signal So, with adaptation of the evolution law, and/or make the parameters of the model change to a rest signal such as the comfort noise 52.

In a variant of the present invention, only two classes of signals are considered, the voiced signals on the one hand, and the weakly voiced or non-voiced signals on the other hand. The advantage of this variant is that the generation of the non-voiced signal will be identical to the weakly voiced synthesis. As indicated previously, the "pitch period" used for the non-voiced signals is a random value, preferably quite large (for example two hundred samples). In a non-voiced block, the previous signal is non-harmonic; by applying the processing within the meaning of the invention to a sufficiently large period, it can be guaranteed that the signal thus generated remains non-harmonic. The nature of the signal will advantageously be retained, which would not be the case when using a randomly-generated signal (for example a white noise).

If the signal is highly voiced (arrow Y at the output of test 51), the lost blocks are replaced by copying the pitch period T. Thus the pitch period T identified in the last still valid part of the received signal Si is determined (using any technique 53 which can be known per se). The samples of this pitch period T are then copied into the lost blocks (reference 54). Then, an appropriate gain 61 is applied to the samples thus replaced (in order to carry out for example an attenuation or "fading").

In the example described, if the signal is averagely voiced (or, in a less sophisticated but more general variant, if the signal is simply voiced), the method within the meaning of the invention is applied (arrow A at the output of test 51 concerned with the degree of voicing).

Figure 1:
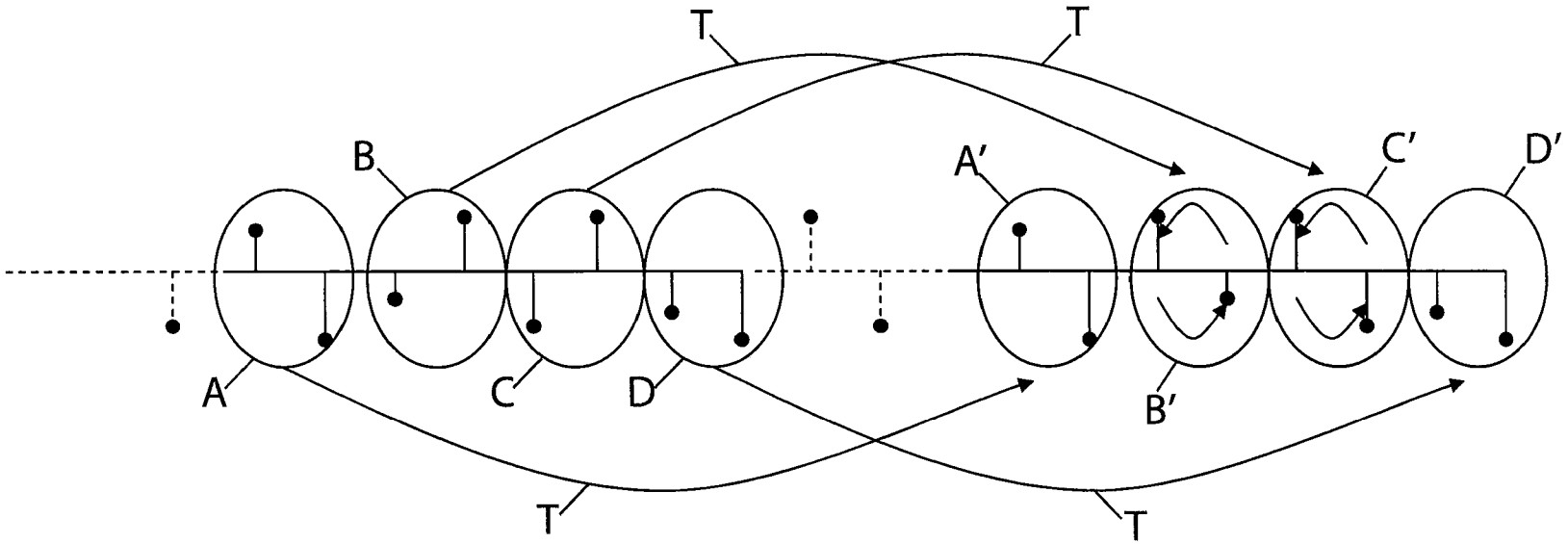
FIG. 1 illustrates the principle of an excitation generation allowing the overvoicing effect to be attenuated, by integrating a random inversion of samples, on blocks of two samples, with a probability of 50% in the example shown, over a whole pitch period.
Figure 2:
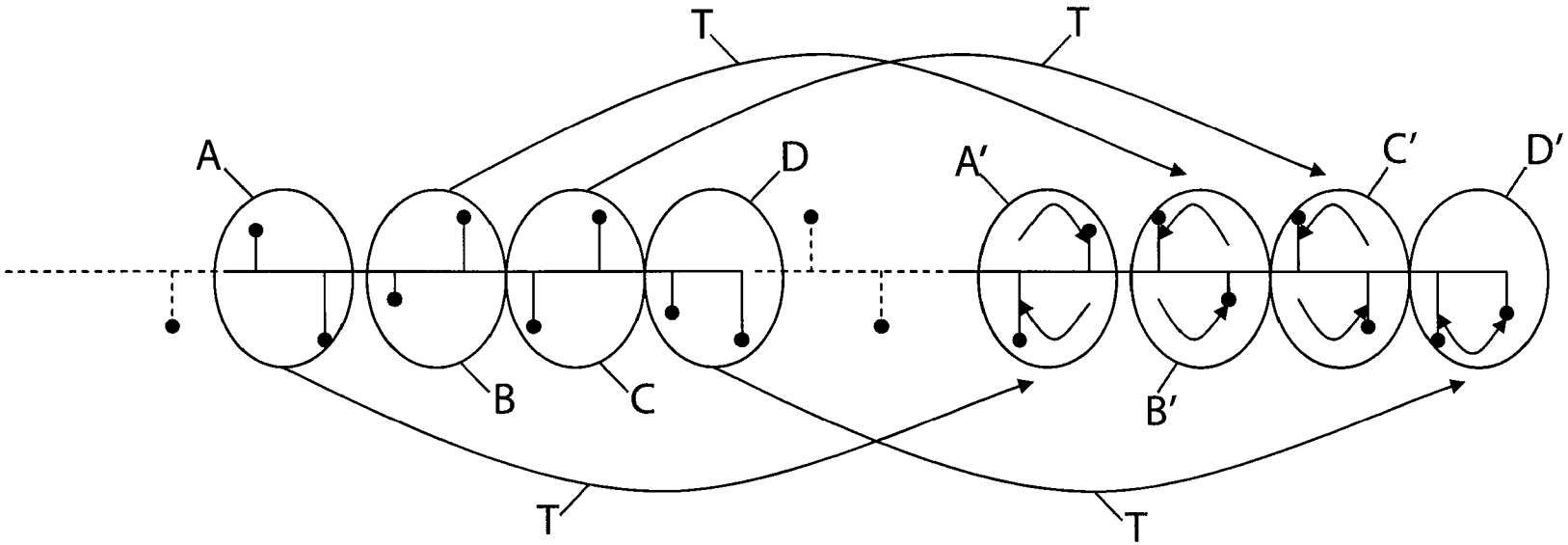
FIG. 2 illustrates the principle of an excitation generation integrating an inversion of samples, which here is systematic, on blocks of two samples in the example represented, over a whole pitch period.

With reference to FIGS. 1 and 2, the principle of the invention consists of assembling the samples of the last valid blocks received, by groups of at least two samples. In the example of FIGS. 1 and 2, these samples have effectively been grouped in pairs. They can however be grouped by more than two samples, in which case the rules for inversion of samples by group and taking into account the parity in number of samples of the pitch period T, described in detail hereafter, would be slightly adapted.

With reference in particular to FIG. 2, the groups A, B, C, D, of two samples in the last valid blocks received are copied and concatenated with the last samples received. However, in these copied groups, referenced A', B', C', D', the values of the two samples in each group have been inverted (or their value retained and their respective positions inverted). Thus, group A becomes group A', with its two samples inverted in relation to group A (according to the two arrows of group A' in FIG. 2). Group B becomes group B', with its two samples inverted in relation to group B, and so forth. The copying and concatenation of the groups A', B', C', D', is carried out advantageously by respecting the pitch period T. Thus, group A', constituted by the inverted samples of group A, is separated from the group A by a number of samples corresponding to the duration of the pitch period T. Similarly, the group B' is separated from the group B by a duration corresponding to the pitch period T, and so forth.

In FIG. 2, the inversion of the samples by group is systematic. In a variant as represented in FIG. 1, the occurrence of this inversion can be randomized. It can even be provided to set a probability threshold p for inverting or not inverting the samples of a group. In the example represented in FIG. 1, the threshold p is set at 50% so that only two groups B', C', out of four, have their samples inverted. It can also be provided to make the threshold of probability p variable, in particular to make it dependent on a correlation function relating to the pitch period T, as will be seen below.

Figure 3A:
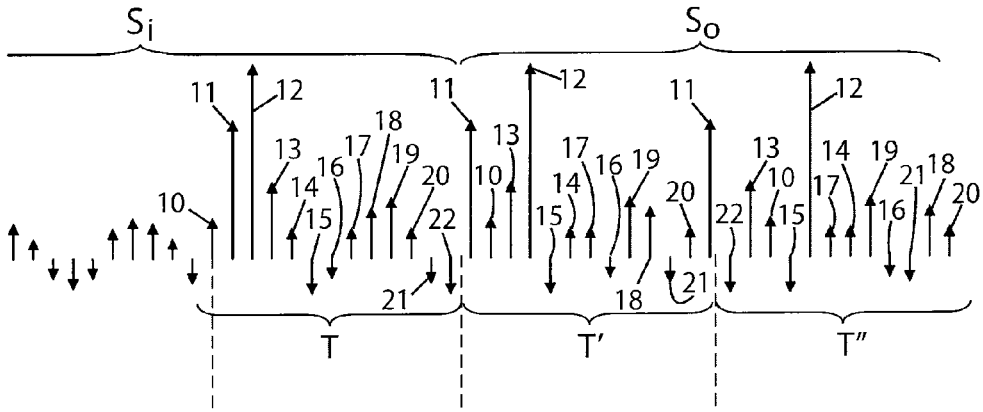
FIG. 3*a* illustrates the application of the systematic inversion of FIG. 2 to a signal, a pitch period of which has been estimated comprising an odd number of samples.

Returning to the description of the embodiment illustrated in FIG. 2, where a systematic inversion of the samples by group is applied, there is obtained, referring now to FIG. 3*a*, a new succession of samples T', having a duration corresponding to the pitch period T, but with inversion of the samples in pairs. In FIG. 3*a* the last samples of the last valid blocks received in the signal Si and which have been stored in a decoder are represented. In this case, as the inversion is systematic and not random with an estimated correlation, the pitch period T of the voiced signal has been determined (by a means known per se) and the last samples 10, 11, etc to 22 of the signal Si, which extend over the duration of the pitch period T have been collected. The two first samples 10 and 11 are inverted in the signal to be reconstructed, marked So. The third and fourth samples 12 and 13 are also inverted, and so forth. A succession T' is obtained of samples 11, 10, 13, 12, etc. which extends over the same duration as the pitch period. If several blocks extending over several pitch periods are missing at decoding, the reconstruction of the signal So is continued by taking the succession T' and recommencing therein the inversion of the samples in pairs of the succession T', in order to obtain a new succession T", and so forth.

In the case of FIG. 3*a*, the number of samples per periods T, T', T" is equal to a single odd number (thirteen samples in the example represented), which makes it possible to obtain a progressive mixture of the samples as the reconstruction of the signal So progresses, and thus an effective attenuation of the over-harmonicity (or, in other words, the overvoicing of the reconstructed signal).

Figure 3B:
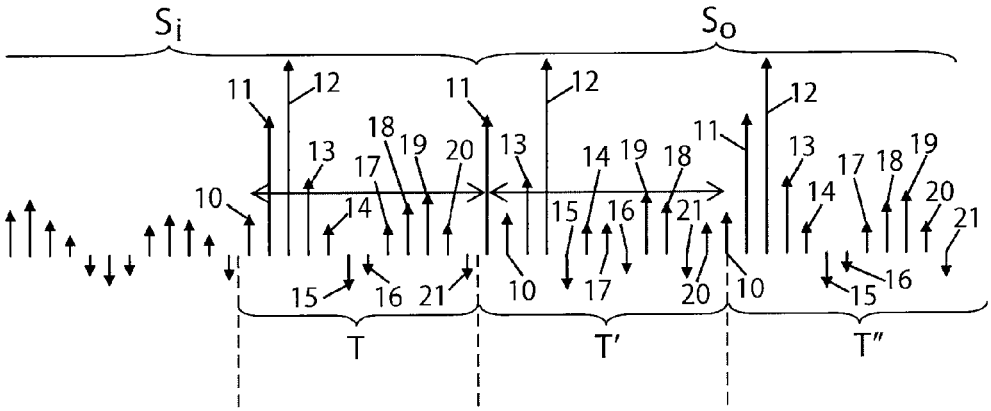
FIG. 3*b* represents, purely by way of illustration, the application of the systematic inversion of FIG. 2 to a signal, a pitch period of which has been estimated comprising an even number of samples.

On the other hand, in the case illustrated in FIG. 3*b* where the number of samples per periods T, T', T" is an even number (twelve samples in the example represented), by carrying out an inversion twice (from period T to period T', then from period T' to period T") of the samples, taken in pairs, of the pitch period T, exactly the same succession is found as the pitch period T in the succession T", which then generates an over-harmonicity.

This problem can be overcome by modifying the number of samples to be inverted per group (and taking for example an odd number of samples per group).

Figure 3C:
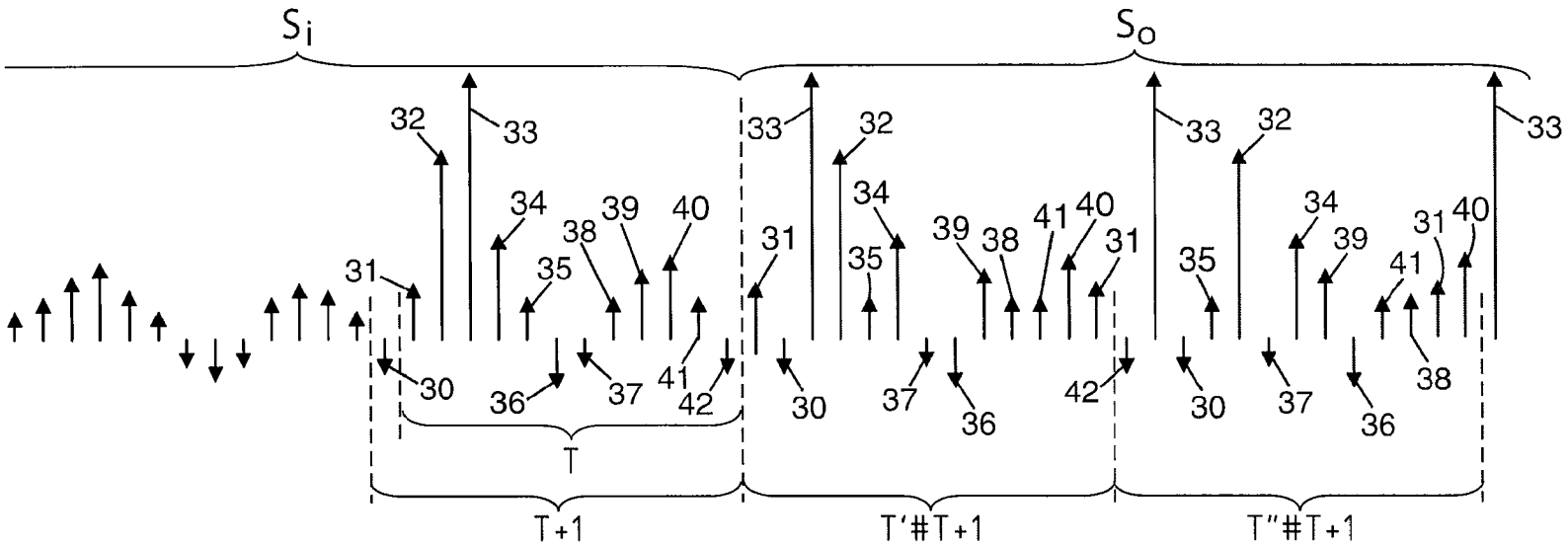
FIG. 3*c* illustrates the application of the systematic inversion of FIG. 2, here with a correction by the addition of a sample to the corresponding duration to the pitch period, in order to make this duration odd in terms of the number of samples that it comprises.

However, a further embodiment is illustrated in FIG. 3*c*. This embodiment consists simply, when the pitch period comprises an even number of samples and when the inversions involve even numbers of samples per group, of adding an odd number of samples to the pitch period of the signal to be reconstructed. In FIG. 3*c*, the last detected pitch period T comprises twelve samples 31, 32, etc. to 42. Then a sample is added to the pitch period and a period T+1 is obtained comprising an odd number of samples. Thus, in the example illustrated in FIG. 3*c*, the sample 30 becomes the first sample of the memory from which the inversion of samples in pairs as illustrated in FIG. 2 (or FIG. 3*a*) is applied. A period T' of the reconstructed signal So is obtained, comprising an odd number of samples to which the inversion of samples in pairs is again applied in order to obtain the period T", once again comprising an odd number of samples, and so forth. It will then be noted that the succession of samples 33, 30, 35, 32, 34, etc. of the period T" is very different, this time, from the succession of samples 30, 31, 32, 33, etc. of the original pitch period T.

Again with reference to FIG. 4 which in the example represented implements the embodiment illustrated in FIGS. 2, 3*a* and 3*c*, when the signal Si is averagely voiced (arrow A at the output of the test 51), the pitch period T is determined on the last samples of the signal Si validly received (by a technique 56 which can be known per se). Detection of whether the samples in the pitch period T are odd or even is carried out. If this number is odd (arrow N at the output of test 57), the inversion of the samples in pairs (step 58) is carried out directly, as described above with reference to FIG. 3*a*. If the number of samples in the pitch period T is even (arrow Y at the output of test 57), a sample is added to the pitch period T (step 59) and then the inversion of the samples in pairs (step 58) is carried out according to the processing described above with reference to FIG. 3*c*. Then optionally, a chosen gain 61 is applied to the succession of samples thus obtained, in order to form the finally reconstructed signal So.

As previously indicated with reference to FIG. 4, the pitch period is firstly calculated from one or more previous frames. Then, the reduced harmonicity excitation is generated in the manner illustrated in FIG. 2, with systematic inversion. However, in the variant illustrated in FIG. 1, it can be generated with random inversion. This irregular inversion of the voiced excitation samples advantageously makes it possible to attenuate the over-harmonicity. This advantageous embodiment is detailed hereafter.

Usually, in a simple copying of the pitch period, the voiced excitation is calculated according to a formula of the type:

$$s(n)=g_{ltp}\cdot s(n-T) \tag{1}$$

where T is the estimated pitch period and $g_{ltp}$ is a chosen LTP gain.

In an embodiment of the invention, the voiced excitation is calculated per group of two samples and with random inversion according to the processing hereafter. Firstly, a random number x is generated in the interval [0; 1], Then, according to the value of x:

if x<p, s(n) and s(n+1) are calculated from the equation (1)

if x≧p, s(n) and s(n+1) are calculated according to the following equations (2) and (3):

$$s(n)=g_{ltp}\cdot s(n-T+1) \tag{2}$$

$$s(n+1)=g_{ltp}\cdot s(n-7) \tag{3}$$

The value p represents the probability of inverting the two samples s(n) and s(n+1). For example, the value p can be set such that p=50%.

In an advantageous variant, a variable probability can also be chosen, for example in the form:

$$p=\text{corr} \tag{4}$$

where the variable con corresponds to the maximum value of the correlation function over the pitch period, marked Corr (T). For a pitch period T, the correlation function Corr(T) is calculated using only $2*T_m$ samples at the end of the stored signal, and:

$$Corr(T)=\frac{2\sum_{i=Lmem-2T_m+T}^{Lmem-1} m_i m_{i-T}}{\sum_{i=Lmem-2T_m}^{Lmem-1} m_i^2+\sum_{i=Lmem-2T_m+T}^{Lmem-1-T} m_i^2} \tag{5}$$

where $m_0 \ldots m_{Lmem-1}$ are the last samples of the previously decoded signal and are still available in the decoder memory.

From this formula, it will be understood that the length of this memory $L_{mem}$ (in number of samples stored) must be equal to at least twice the maximum value of the duration of the pitch period (in number of samples). In order to take into account the lowest voices (lowest fundamental frequency of the order of 50 Hz), the number of samples to be stored can be of the order of 300, for a low narrowband sampling rate and more than 300 for higher sampling rates.

The correlation function corr(T), given by the formula (5), reaches a maximum value when the variable T corresponds to the pitch period $T_0$ and this maximum value gives an indication of the degree of voicing. Typically, if this maximum value is very close to 1, then the signal is highly voiced. If it is close to 0, the signal is not voiced.

It will thus be understood that in this embodiment, the prior determination of the pitch period is not necessary for constructing the groups of samples to be inverted. In particular, the determination of the pitch period $T_0$ can be carried out jointly with the constitution of the groups within the meaning of the invention, by applying the formula (5) above.

If the signal is highly voiced, then the probability p will be very high, and the voicing will be retained in accordance with the calculation according to the formula (1). If, on the other hand, the voicing of the signal Si is not very marked, the probability p will be lower and advantageously the equations (2) and (3) are used.

Of course, other correlation calculations can also be used.

For example, it is also possible of calculate the harmonic excitation according to predefined classes. For the highly voiced classes, the equation (1) is preferably used. For the averagely or weakly voiced classes, the equations (2) and (3) are preferably used. For the non-voiced classes, no harmonic excitation is generated and the excitation can then be generated from a white noise. However, in the previously described variant, the equations (2) and (3) are also used with a sufficiently large arbitrary pitch period.

More generally, the present invention is not limited to the embodiments described above by way of example; it extends to other variants.

In the context of the embodiment of the invention described in detail above, the excitation generation in coding by CELP predictive synthesis aims to avoid overvoicing in the context of frame transmission error concealment. It can nevertheless be envisaged to use the principles of the invention for band extension. It is then possible to use the generation of an extended-bandwidth excitation in a band extension system (with or without data transmission), based on a model of the CELP (or CELP sub-band) type. High-band excitation can then be calculated as described previously, which then makes it possible to limit the over-harmonicity of this excitation.

Moreover, the implementation of the invention is particularly suitable for frame or packet transmission of signals over networks, for example "voice over internet protocol (VOIP)", in order to provide an acceptable quality over IP when such packets are lost, while nevertheless guaranteeing a limited complexity.

Of course, the inversion of the samples can be carried out on groups of samples of a size greater than two.

Moreover, the generation of a replacement block for an invalid block from samples of a valid block preceding the invalid block has been described above. In a variant, it is possibly to rely instead on a valid block succeeding the invalid block in order to carry out the synthesis of the invalid block (a posteriori synthesis). This implementation can be advantageous, in particular for synthesizing several successive invalid blocks and in particular for synthesizing:

invalid blocks immediately succeeding the preceding valid blocks, from these preceding blocks, then invalid blocks immediately preceding the following valid blocks, from these following blocks.

The present invention also involves a computer program intended to be stored in the memory of a digital audio signal synthesis device. This program then comprises instructions for the implementation of the method within the meaning of the invention, when it is executed by a processor of such a synthesis device. Moreover, the previously-described FIG. 4 can illustrate a flow-chart of such a computer program.

Figure 5:
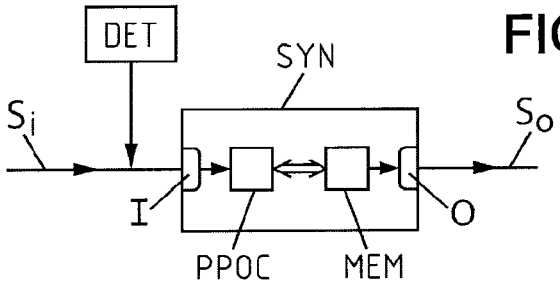
FIG. 5 illustrates very diagrammatically the structure of a device for receiving a digital audio signal comprising a synthesis device for the implementation of the method within the meaning of the invention.

Moreover, the present invention also involves a digital audio signal synthesis device constituted by a succession of blocks. This device could further comprise a memory storing the above-mentioned computer program. With reference to FIG. 5, this device SYN comprises:

an input I for receiving blocks of the signal Si, preceding at least one current block to be synthesized, and an output O for delivering the synthesized signal So and comprising at least this current block to be synthesized.

The synthesis device SYN within the meaning of the invention comprises means such as a working storage memory MEM (or memory for storing the above-mentioned computer program) and a processor PROC cooperating with this memory MEM, for implementation of the method within the meaning of the invention, and thus for synthesizing the current block starting from at least one of the preceding blocks of the signal Si.

The present invention also involves a device for receiving a digital audio signal constituted by a succession of blocks, such as a decoder of such a signal for example. Again with reference to FIG. 5, this device can advantageously comprise a detector of invalid blocks DET, as well as the device SYN within the meaning of the invention for synthesizing invalid blocks detected by the detector DET.

The invention claimed is:

1. A method for synthesizing a digital audio signal, represented by consecutive blocks of samples, in which on receiving such a signal, in order to replace at least one invalid block, a replacement block is generated from the samples of at least one valid block preceding the invalid block, comprising the following steps:

a) selecting a chosen number of samples forming a succession in at least one last valid block preceding the invalid block, b) fragmenting the succession of samples into groups of samples, and, in at least one part of the groups, inverting the samples according to predetermined rules, c) re-concatenating the groups, the samples of some of which at least have been inverted in step b), in order to form a part at least of the replacement block, and d) if said part obtained in step c) does not fill the whole of the replacement block, copying said part into the replacement block and applying steps a), b), c) again to said copied part, wherein the fragmentation of step b) is carried out by groups of two samples, and the positions of the samples of a single group are inverted one with the other.

2. The method according to claim 1, in which the digital audio signal is a speech signal, wherein a degree of voicing is detected in the speech signal and steps a) to d) are applied if the signal is at least weakly voiced.

3. The method according to claim 1, in which the digital audio signal is a speech signal, wherein a degree of voicing is detected in the speech signal and steps a) to d) are applied if the signal is weakly voiced or non-voiced.

4. The method according to claim 1, wherein, in order to carry out step a):

a1) a tone is detected in the digital audio signal, and a2) said chosen number of samples selected in step a) corresponds to the number of samples that are comprised in a period corresponding to the inverse of a fundamental frequency of the detected tone.

5. The method according to claim 1, wherein, in order to carry out step a):

a1) a tone is detected in the digital audio signal, and a2) said chosen number of samples selected in step a) corresponds to the number of samples that are comprised in a period corresponding to the inverse of a fundamental frequency of the detected tone, and wherein, if the number of samples comprised in the period of the detected tone is an even number, an odd number of samples is added to or subtracted from the samples of said period in order to form the selection of step a).

6. A non-transitory memory in a digital audio signal synthesis device comprising a computer program comprising instructions for the implementation of the method according to claim 1 when it is executed by a processor of such a synthesis device.

7. A digital audio signal synthesis device constituted by a succession of blocks, comprising:

an input for receiving blocks of the signal, preceding at least one current block to be synthesized, and an output for delivering the synthesized signal and comprising at least said current block, comprising means for the implementation of the method according to claim 1, for synthesizing the current block starting from at least one of said preceding blocks.

8. A device for receiving a digital audio signal constituted by a succession of blocks, comprising a detector of invalid blocks, comprising moreover a device according to claim 7, for synthesizing invalid blocks.

9. A method for synthesizing a digital audio signal, represented by consecutive blocks of samples, in which on receiving such a signal, in order to replace at least one invalid block, a replacement block is generated from the samples of at least one valid block preceding the invalid block, comprising the following steps:

a) selecting a chosen number of samples forming a succession in at least one last valid block preceding the invalid block, b) fragmenting the succession of samples into groups of samples, and, in at least one part of the groups, inverting the samples according to predetermined rules, c) re-concatenating the groups, the samples of some of which at least have been inverted in step b), in order to form a part at least of the replacement block, and d) if said part obtained in step c) does not fill the whole of the replacement block, copying said part into the replacement block and applying steps a), b), c) again to said copied part, wherein said predetermined rules require that the instances of inversion of samples in each group are randomized and that a probability threshold is set for inverting or not inverting the samples of a group.

10. The method according to claim 9, wherein, in order to carry out step a):

a1) a tone is detected in the digital audio signal, and a2) said chosen number of samples selected in step a) corresponds to the number of samples that are comprised in a period corresponding to the inverse of a fundamental frequency of the detected tone, and wherein the probability threshold is variable and depends on a correlation function relating to said period.

11. A non-transitory memory in a digital audio signal synthesis device comprising a computer program comprising instructions for the implementation of the method according to claim 9 when it is executed by a processor of such a synthesis device.

12. A digital audio signal synthesis device constituted by a succession of blocks, comprising:

an input for receiving blocks of the signal, preceding at least one current block to be synthesized, and an output for delivering the synthesized signal and comprising at least said current block, comprising means for the implementation of the method according to claim 9, for synthesizing the current block starting from at least one of said preceding blocks.

13. A device for receiving a digital audio signal constituted by a succession of blocks, comprising a detector of invalid blocks, comprising moreover a device according to claim 12, for synthesizing invalid blocks.

* * * * *